US005546637A

United States Patent [19]

Niedecker

[11] Patent Number: 5,546,637

[45] Date of Patent: Aug. 20, 1996

[54] TWO-PART PLASTIC CLIP FOR CLOSING SAUSAGE CASINGS, BAGS OR THE LIKE

[76] Inventor: Herbert Niedecker, Am Ellerhang 6, DE 61462, Konigstein, Germany

[21] Appl. No.: 244,095

[22] PCT Filed: Nov. 12, 1992

[86] PCT No.: PCT/EP92/02634

§ 371 Date: Jul. 25, 1994

§ 102(e) Date: Jul. 25, 1994

[87] PCT Pub. No.: WO93/10012

PCT Pub. Date: May 27, 1993

[30] Foreign Application Priority Data

Nov. 14, 1991 [DE] Germany ..... 41 37 478.9

[51] Int. Cl.[6] ..... B65D 77/10; F16L 55/00; A22C 11/12

[52] U.S. Cl. ..... 24/30.5R

[58] Field of Search ..... 24/30.5 R, 459, 24/575, 625

[56] References Cited

U.S. PATENT DOCUMENTS

| | | | |
|---|---|---|---|
| 3,164,250 | 1/1965 | Paxton | 24/30.5 S |
| 3,171,184 | 3/1965 | Posse | 24/543 X |
| 4,128,922 | 12/1978 | Hutchison | 24/30.5 R |
| 4,275,485 | 6/1981 | Hutchison | 24/30.5 R |
| 4,405,161 | 9/1983 | Young et al. | 24/459 X |
| 4,416,038 | 11/1983 | Morrone, III | 24/487 |
| 5,189,766 | 5/1993 | Weber | 24/459 |

FOREIGN PATENT DOCUMENTS

| | | | |
|---|---|---|---|
| 1326485 | 4/1963 | France | 24/30.5 R |

*Primary Examiner*—Peter M. Cuomo
*Assistant Examiner*—Robert J. Sandy
*Attorney, Agent, or Firm*—Sprung Horn Kramer & Woods

[57] ABSTRACT

In a plastic clip which serves to close sausage casings, bags or the like and consists of two interlockable parts (1, 10), at least one part (1) consists of an elongate frame, which has side bars (2), which have a large height in relation to their wall thickness. The side bars (2) are provided with central recesses (4), into which the end of the wrapper, which end has been gathered to form a tip, can be inserted. The other part (1; 10) together with the first part encloses the wrapper and that has been gathered to form a tip. At least the other part (1; 10) is provided with a projection, which consists of a rib (13), which extends parallel to the side bars and protrudes into the interior (5) of the frame. That projection deflects the tip in wave shape and applies pressure to the tip at the same time. For this reason, the clip will have a maximum elastic yieldability and, as a result, a maximum adaptability to different tip thicknesses or different pressures in the closed interior space in conjunction with a strong and uniform seal whereas the firm detent connection is not adversely connected. In a first embodiment the two clip parts are identical. In a second embodiment the first part encloses the tip by a U-shaped recesses, which are formed in the side walls and closed by the second part.

18 Claims, 6 Drawing Sheets

TWO-PART PLASTIC CLIP FOR CLOSING SAUSAGE CASINGS, BAGS OR THE LIKE

Figure 1:
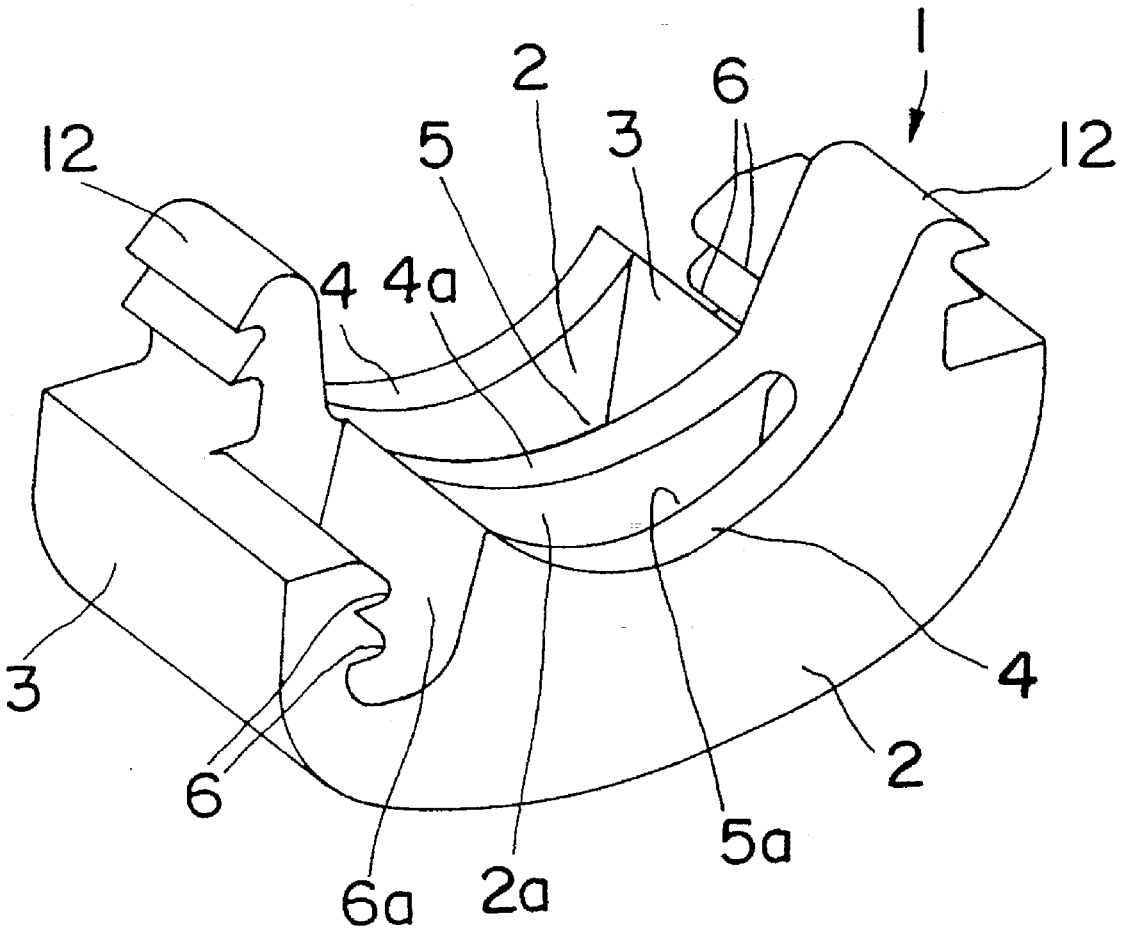

This invention relates to a plastic clip which serves to close sausage casings, bags or the like and consists of two parts, which embrace the wrapper end that has been gathered to form a tip and are adapted to be interlocked, and the tip is deflected in wave shape by at least one inwardly directed projection and is subjected to an applied pressure when the clip is in its interlocked closed state.

Such a plastic clip is known, e.g., from German Patent Specification 10 23 693. In that case one part consists of a capsule, which is circular in a top plan view and adjacent to mutually opposite sectors of its periphery is provided with correspondingly curved uprights on a substantially flat bottom. The tip of the wrapper end is inserted between the uprights and is fixed by being clamped by a cover, which constitutes the second clip part and interlocks with detent projections at the top edges of the uprights. A pin which is integrally formed with the bottom of the first part forces the tip in wave shape into a corresponding recess of the cover part.

A problem arising in connection with such plastic clips resides in that the pressure which is applied by them to the wrapper material (i.e., the pressure which is applied by the clip after it has been closed) is determined by the geometrically defined size of the passage which is left free by the two parts when they have been closed. For this reason any change of the volume of the wrapper material which extends through that passage as a tip will result in a corresponding change of the pressure applied. In addition to the fact that it is not possible to make clips of a separate size for each wrapper size, even small differences in the thickness of the wrapper material will exert possibly detrimental influences on the pressure applied. If the tip volume is too large it will no longer be possible to cause the cover to snap behind the detent projections at the uprights of the capsule. If the tip volume is too small the required (hermetically) tight seal of the package will no longer be ensured.

For this reason it has been attempted to eliminate that disadvantage, which is ascribed to the interlock between the two clip parts, and to achieve this in that the wrapper tip is inserted into a bar which is bent in U-shape, the legs of the U are inserted through a frame and the U-shaped bar is fixed in the frame in that the U-shaped bar is pressed against the frame by means of wedges which are forced inwardly opposite to the inserting direction. Whereas this will permit a change of the passage for the wrapper tip in adaptation to the tip volume by a corresponding variation of the insertion of the U-shaped bar into the frame, this will be possible only at the closing time. Any later change of the volume of the closed tip by thermal processes or processes due to aging will result in a change of the pressure applied to the wrapper tip because in that case the geometry of the passage which has been formed during the closing operation and receives the tip material will not be changed. Besides, the frictional connection between the U-shaped bar and the frame which surrounds the legs of said bar, which frictional connection has been established by the wedging, is not sufficiently resistant to separation.

The invention intends to solve the problems set forth hereinbefore. It resides in that at least one part of the plastic clip consists of an elongate frame, which extends transversely to the longitudinal direction of the tip and is optionally closed on the outside and has side bars, which are relatively high relative to their wall thickness and have centrally disposed aligned recesses, and that the projection is integrally formed at least with the second part, which substantially covers the frame on the side on which the recesses are disposed, and the projection consists of a rib, which is parallel to the side bars and protrudes into the interior of the frame. The interior of the frame constitutes a chamber, into which the tip of the wrapper end is deflected and the volume of which can be changed within certain limits in that the side bars of the frame are elastically deformed. The wall thickness of the side bars and the modulus of elasticity of the plastic material an properly be selected so that elastic deformation of the side bars of the frame can be so controlled that a substantially equal pressure, which is required to seal the tip, will always be exerted on the tip even in case of fluctuations of the tip volume.

In a first embodiment of the invention both parts are framelike and are identically provided each with a projection, which is eccentrically disposed and extends in the longitudinal direction, and are adapted to interlock by oppositely directed recesses. This affords the great advantage that contrary to what was conventional before only one clip part (in duplicate) is required so that the manufacturing costs, the stocking and the feeding of clips to be attached will be simplified.

In that embodiment it is particularly provided that the recesses in the side bars are arcuate and the rib is an intermediate bar, which is recessed to a smaller depth and extends parallel to the side bars. Because the two identical clip parts are connected by an overhead joint, their sides are interchanged relative to each other so that the interlock (with detent recesses and detent arms offset with respect to the side bars) can be effected and the projection which is eccentrically disposed with respect to the longitudinal direction of the tip and consists of the intermediate bar will always face the wider chamber portion, which is defined in the frame by the intermediate bar of the other clip part. As a result, although each chip part comprises only one projection, the wrapper tip will repeatedly be deflected in the closed clip.

In another embodiment of the spirit of the invention a first part of the clip comprises an open frame, the side bars of which comprise U-shaped recesses, a second part closes the U-shaped recesses of the first part, and the rib is integrally formed with the second part. In addition to the elastic deformation of the side bars of the frame to effect the above-described 'bulging', the fact that in accordance with the invention the U-shaped recesses are formed in the side bars and guide the wrapper tip and the pressure is applied to the tip by the rib at the second clip part will result in th exertion of a force also in the plane of the side bars of the frame, i.e., at right angles to the bulging forces, which act in the axial direction of the tip. Said forces which are directly exerted as a result of the compression of the wrapper tip act to widen the U-shaped recesses in the side bars of the frame because said recesses obviously weaken each side bar adjacent to the bight of the U. They produce corresponding restoring forces in the side bars. Just as the section modulus which determines the bulging of the frame bars, the section modulus which determines the widening can be influences by the design and by the selection of the material.

This has the result that in spite of the fixed geometry of the clip parts which are joined by a snap joint, the wrapper tip is closed by a plastic clip in such a manner that a tight seal will be effected in the tip portion of the wrapper even in case of distinct fluctuations of the various parameters, many of which have been discussed hereinbefore. Besides, that closure can then elastically yield and can permit liquid and/or gaseous material to escape from the interior of the wrapper through the tip if that interior—e.g., during the cooking or sterilizing of a sausage—is pressurized to a high pressure. It has finally been found that in the plastic clip, which is elastically yieldable in several directions, the tip of the wrapper is virtually 'massaged' to achieve a particularly tight seal.

According to a further feature of the plastic clip in accordance with the invention the side bars of the frame are interconnected by cross-bars, which are formed with detent recesses, which are engaged in the closed state by the detent arms integrally formed with the other part. In the embodiment described last hereinbefore this renders the snap joint independent of the widening of the U-shaped recesses in the side bars. In that case it will be particularly desirable so to arrange the detent arms of the second part that—when viewed in the direction of the U-shaped recesses in the side bars—they are disposed beside the U-shaped recesses which are constituted by the recesses in the side bars and the detent arms are offset in the direction of view. In that case the wrapper tip which has already been inserted into the U-shaped recesses during the closing operation will not prevent the detent arms from entering the interior of the frame: Corresponding passages are left free on both sides of the wrapper tip between the latter and the adjacent cross-bars of the frame.

An even higher safety regarding the permanent seal of the wrapper tip will be achieved if, according to a further feature, the (correspondingly wide) frame of the first part is subdivided by an intermediate bar, which is parallel to the side bars, the intermediate bar has a recess, which has a smaller depth than the recesses in the side bars, and the second part comprises two pairs of detent arms, which extend into respective chambers of the frame. In simpler language this means that two plastic clips of the kind described hereinbefore are so juxtaposed that their adjoining side bars are combined to form the intermediate bar and the recess in the intermediate bar has a smaller depth than the recesses in the outer side bars. The latter fact results in a stronger deflection of the tip in the plane of the intermediate bar and in a section modulus which is higher than that of the side bars with respect to forces exerted at right angles to the axis of the tip. The deflecting and sealing functions of the higher intermediate bar can be increased in that the first part is formed with a slot, which is disposed in the plane of the intermediate bar and receives the wrapper tip as it is depressed by the higher intermediate web.

Further desirable features of the invention are subject matters of other dependent claims.

It is also pointed out that the prior EP-A-481,235, which is no prior publication, describes two-part plastic clips, which consist of different parts and in which a projection provided on one part partly forces the wrapper tip into a chamber formed in the other part and elastically deforms the wrapper tip in dependence on the tip volume and on any pressure that has built up in the interior of the wrapper. But that tendency to deform is not opposed by the elastic resistance of a closed frame because the cross-bars on two opposite sides of the chamber are severed by so-called relief cuts. For this reason an elastic bulging of the side bars is not effected—or in any case is not effected in the first place—but the side bars are spread apart in an inverted V-shape. A frame as taught by the present invention requires a peripherally closed series of walls, which can transmit tensile and bending forces without an interruption.

Illustrative embodiments of the invention are shown in the drawings, in which

Figure 2C:
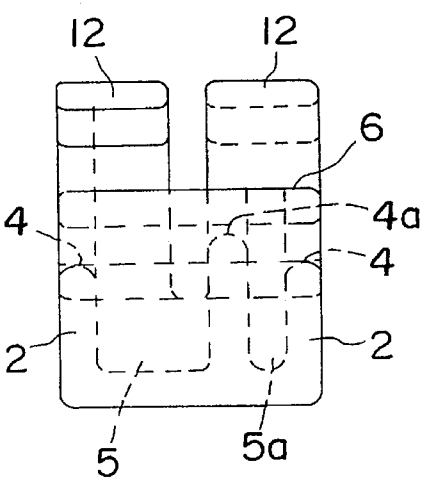
Figure 2A:
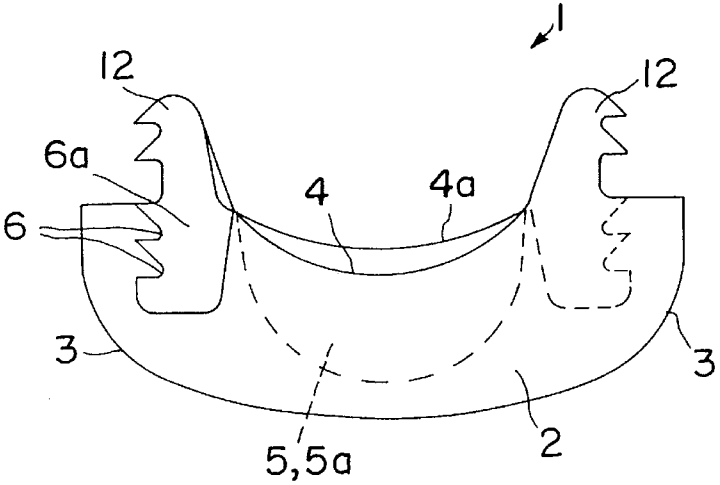
Figure 2B:
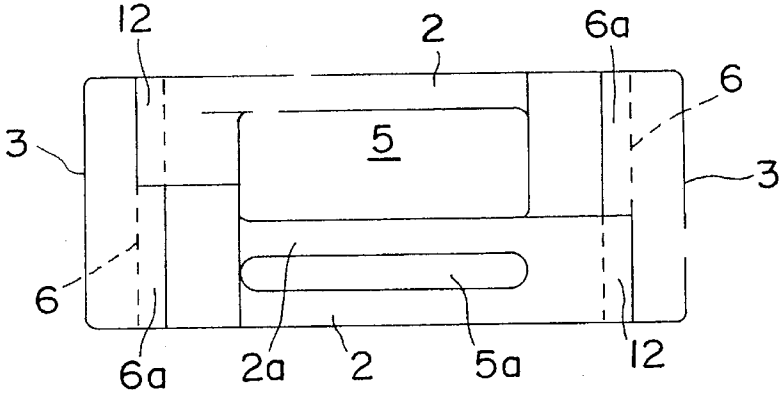
Figure 3A:
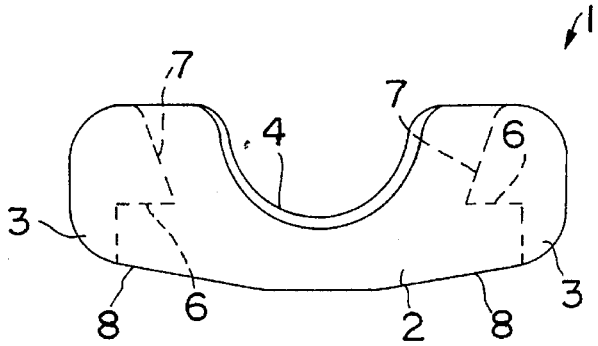
Figure 3C:
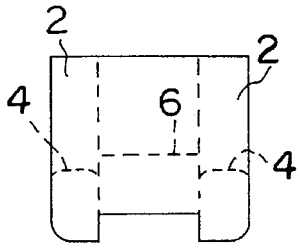
Figure 3B:
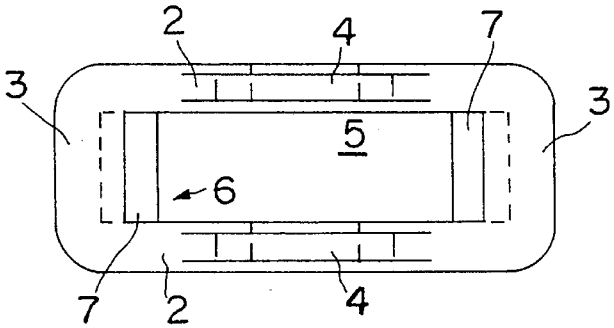
Figure 4A:
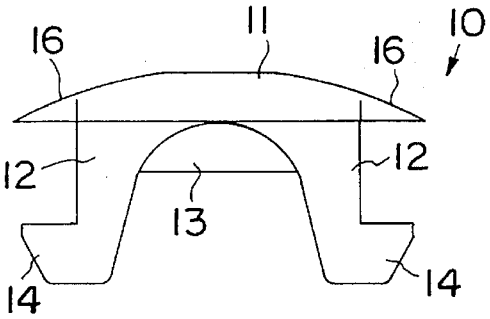
Figure 4C:
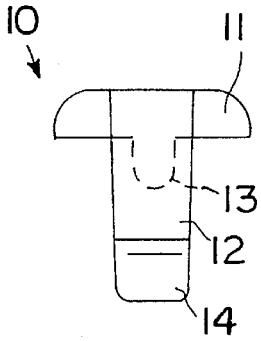
Figure 4B:
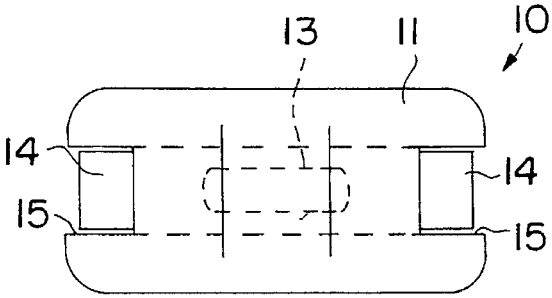
Figure 5A:
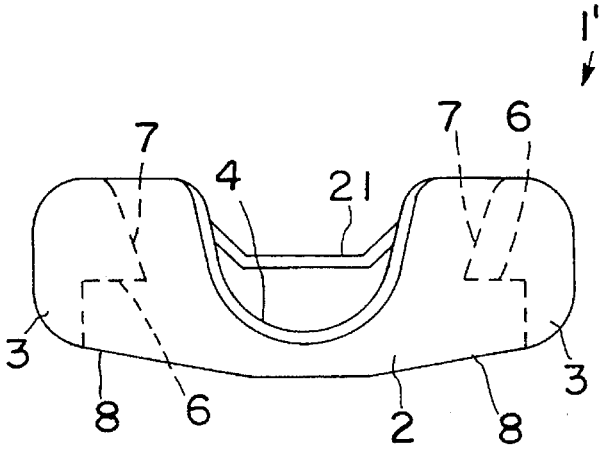
Figure 5C:
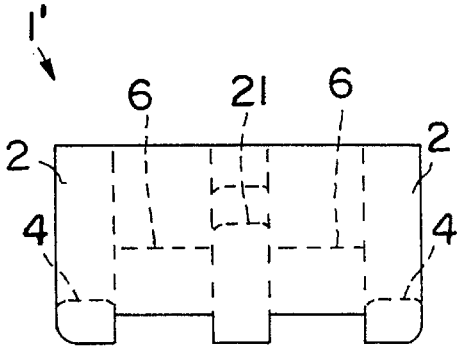
Figure 5B:
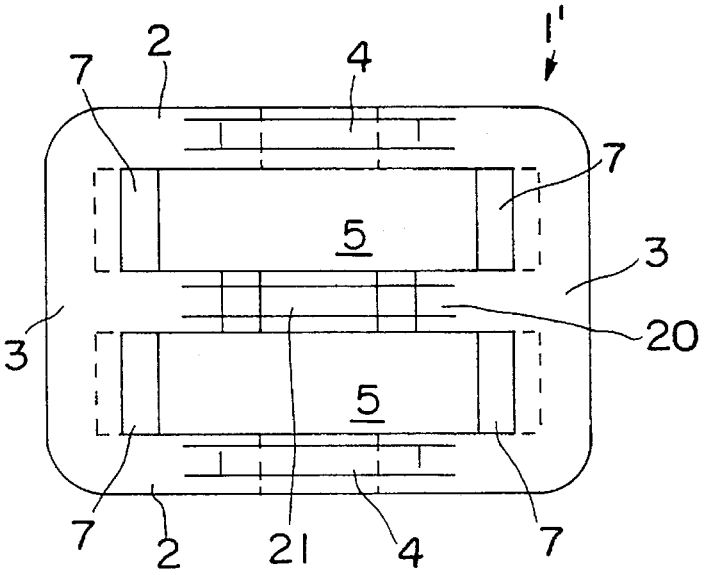
Figure 6A:
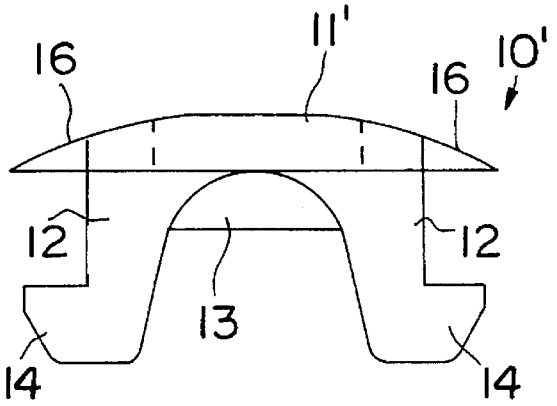
Figure 6C:
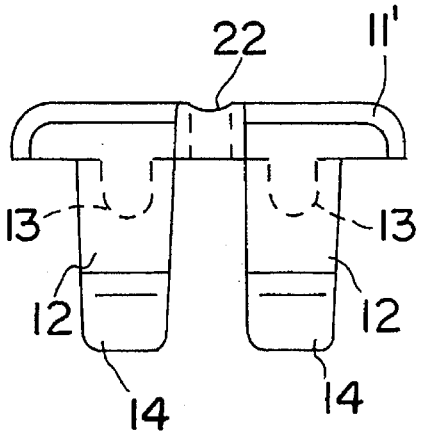
Figure 6B:
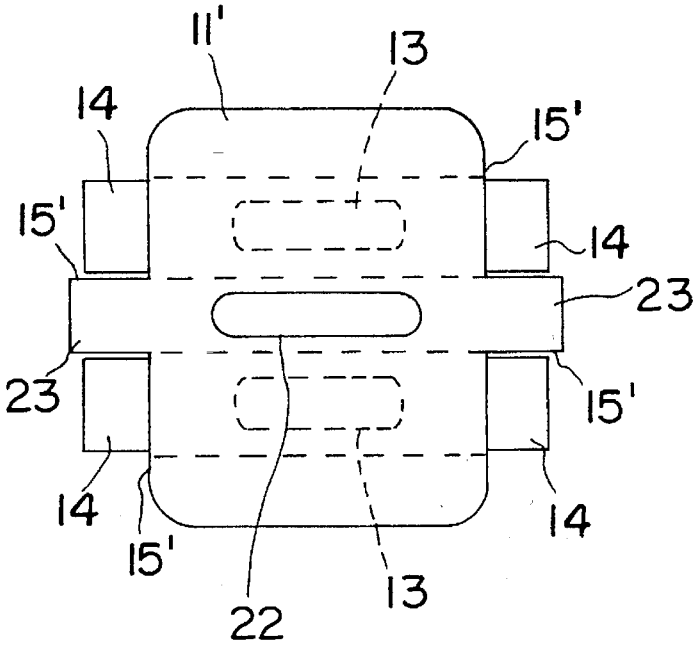
Figure 8B:
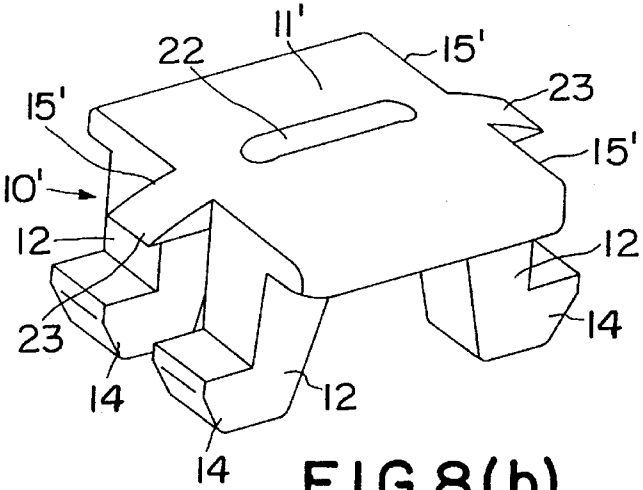
Figure 8A:
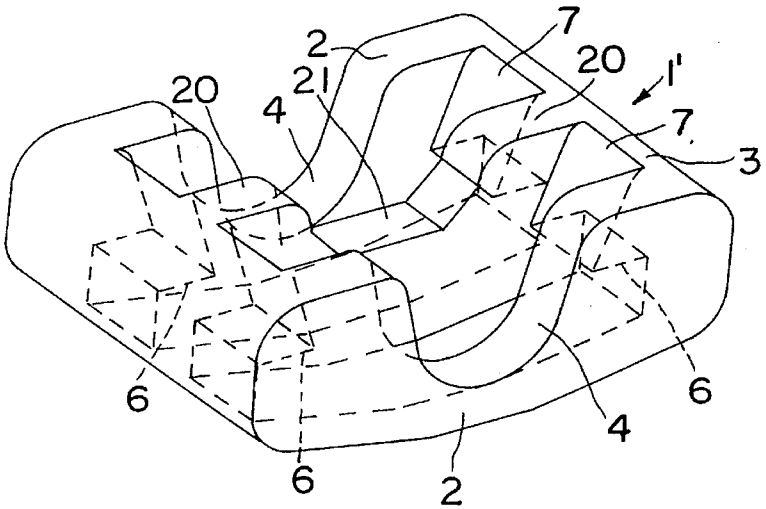
Figure 7B:
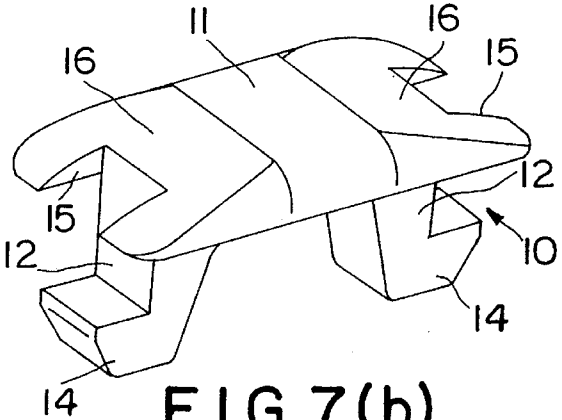
Figure 7A:
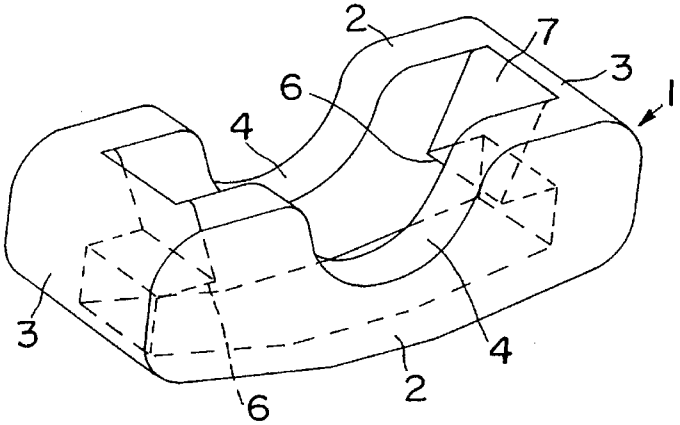

FIG. 1 is a perspective view showing one half of the plastic clip which has been described hereinbefore as the first embodiment of the invention, FIG. 2 comprises a side elevation (a), a top plan view (b), and an end elevation (c) showing the same clip part, FIG. 3 comprises a side elevation (a), a top plan view (b), and an end elevation (c) showing the first part of another embodiment of a plastic clip in accordance with the invention as described hereinbefore, FIG. 4 is a corresponding representation showing in a side elevation (a), a top plan view (b), and an end elevation (c) the associated second part, FIG. 5 is a representation corresponding to FIG. 3 and shows the first part of another illustrative embodiment, FIG. 6 is a representation like FIG. 4 and shows the second part of that illustrative embodiment, FIG. 7 is a perspective view showing the first part (a) and the second part (b) of the illustrative embodiment shown in FIGS. 3 and 4, and FIG. 8 is a perspective view showing the first part (a) and the second part (b) of the illustrative embodiment shown in FIGS. 5 and 6.

FIG. 1 is a perspective view showing one half of the first embodiment of the plastic clip in accordance with the invention. The other half is constituted by an identical plastic part, which relative to the showing in FIG. 1 has been turned through 180° about the longitudinal axis of the tip of a sausage casing or the like, which is now shown. That longitudinal axis extends from bottom right to top left. It is apparent that said two identical parts can be interlocked owing to their relative rotation.

For this reason each of said two parts consists of the side bars 2 and the cross-bars 3, which are thicker than the side bars. The arcuate dash line in FIG. 2(*a*) indicated that the frame is closed on the outside. The representations in FIGS. 1 and 2 are highly enlarged, out in practice, e.g., the side bars 1 have a thickness of only 1 mm. Between the side bars 2, an intermediate bar 2*a* is eccentrically disposed (see FIG. 2(*a*)), which is parallel to the side bars and by which the interior of the frame that is enclosed by the side bars 2 and the cross-bars 3 is divided into two chambers 5 and 5*a*. On the inside, i.e., in the edge which in a closed state faces the respective other part, the side bars 2 and the intermediate bar 2*a* are formed with recesses 4 (in the side bars 2) and 4*a* (in the intermediate bar 2*a*). The recess 4*a* has a smaller depth than the recesses 4 so that in a side elevation the recess 4*a* protrudes over the recesses 4 and thus constitutes a projection relative to the recesses 4.

Both cross-bars 3 are formed with juxtaposed detent recesses 6*a* and detent arms 12. The width of the detent arms 12 is only slightly smaller than one-half of the width of the side bars 3. Besides—as is apparent from FIG. 1—the detent recesses 6 and the detent arms 12 of both side bars of each clip half are interchanged crosswise. For this reason the interlock in the closed clip is effected by means of four detent arms 12, each of which interlocks with the oppositely disposed detent projection 6 (and thus enters the corresponding recess 6*a* in the side bar 3). It is also apparent that in that closed state each intermediate bar 2*a* of one clip part 1 deflects the wrapper tip (not shown) into the chamber 5 of the other part 1.

The first part 1 of a first illustrative embodiment of the other embodiment of the invention is shown in FIG. 3 and in the top plan view (FIG. 1*b*) consists of a frame having side bars 2 and cross-bars 3, which connect the side bars 2. In the example illustrated on an enlarged scale the side bars 2 have a wall thickness of about 1.5 mm. The crossbars 3 are much shorter than the side bars 2 so that the entire frame is elongate.

The side bars 2 are formed with centrally disposed U-shaped recesses 4, which—as shown in FIG. 3*a*—are aligned in a side elevation. Adjacent to their bottom the recesses 4 decrease the relatively large height of the side bars 2 and so that the section modulus that opposes forces which act on the side bars 2 in their plane and tend to widen the U-shaped recesses 4 is correspondingly decreased.

Detent projections 6 are provided on the cross-bars 3 and directed toward the interior 5 of the frame and have side edges 7, which diverge in the direction in which the recesses 4 open. In a manner which will be explained hereinafter said detent projections 6 cooperate with detent arms of the second part 10 (FIG. 4). The side bars 2 are formed on their underside with oblique portions 8, by which the height of the side bars 2 is slightly reduced toward the cross-bars 3. This will be discussed further hereinafter.

FIG. 4 shows the second part 10, which is associated with the first part 1 described hereinbefore. The second part 10 consists mainly of a cover 11, which has arms 12, which downwardly project substantially at right angles and have a width which is only a part of the width of the cover 11, as is particularly illustrated in FIG. 4*c*. This shows also that the arms 12 taper downwardly.

A rib 13, which has a still smaller width, is disposed between the arms 12 and merges integrally into them. Outwardly facing detent hoses 14 are provided at the free ends of the arms 12. Where the cover 11 protrudes in its longitudinal direction over the arms 12, the cover 11 has recesses 15, which have a width corresponding to that of the arms 12. The cover 11 is cambered on its top or has portions 16 which are cambered toward its transverse edges.

To apply the plastic clip, the sausage casing or the like, which has been pleated to form a tip, is inserted into the U-shaped recesses 4 in the side bars 2 of the first part 1 so that the tip bridges the two side bars 2 and extends through the interior 5 of the frame. The arms 12 of the second part 10 are then inserted into the interior 5 of the part 1 on both sides of the tip, which bridges the U-shaped recesses 4. In that operation the outside surfaces of the detent hoses 14 slide along the beveled surfaces 7 so that the side bars 2 are spread adjacent to the U-shaped recesses 4 until the detent hoses 14 of the second part snap behind the detent projections 6 of the first part 1. In that closed state the rib 13 forces the tip into the interior 5 between the side bars 2. As a result, the tip, which is clamped between the side bars 2 and the cover 11, is deflected by the rib 13 in wave shape. In dependence on the tip volume the interior 5 of the frame is increased in size in that the forces acting on the inside of the frame bars 2 in a direction which is parallel to the axis of the wrapper tip may 'bulge' (curve outwardly) the frame bars 2 and in case of a tip volume which exceeds the rated volume will provide a sufficiently large space whereas the pressure applied to the tip will not be substantially changed. This will also be the case if the tip volume decreases by a shrinkage or the like. Finally, the flexibility of the frame 2, 3 and the resulting possibility to change the interior 5 of the frame will permit a corresponding internal pressure within the casing, the bag or the like to be relieved, e.g., in that liquid or gaseous components of the contents escape whereas the sealing pressure applied by the clip is not subsequently reduced or even eliminated.

A similar action is due to the fact that the U-shaped recesses 4 in the side bars 2 of the frame can be widened. Because the frame bars have a smaller height, the side bars 2 can be elastically deformed by corresponding forces and can thus increase the size of the passage for the tip of the wrapper. Besides, as has been described, that deformability is also utilized as the clip is closed. In that case the female die may have a flat supporting surface because the oblique portions 8 of the first part 1 permit that spreading of the frame bars 2. The punch should conform to the contour of the cover 11.

The illustrative embodiment shown in FIGS. 5 and 6 is substantially obtained by a juxtaposed position of two unit clips of the embodiment described hereinbefore so that an intermediate web 20 is provided between the two outer side bars 2 of the first part 1'. The intermediate bar 20 has a recess 21', which has approximately the shape of a trapezoid or trough and is aligned with the U-shaped recesses 4 in the side bars 2 and has a smaller depth than the recesses 4 (FIG. 5*a*). Because the second part 10' (FIG. 6) is substantially a duplication of the part 10 (FIG. 4), the tip will be oppositely deflected upwardly between the two ribs 13 of the cover 11' so that a still better seal will be effected in the tip. The cover 11' of the second part 10' is formed in the plane of the intermediate bar 20 of the first part 1' with a slot 22, which assists that action and permits the position of the tip to be recognized from the outside.

The cover 11' of the second part 10' is also formed adjacent to the arms 12 with recesses 15', which owing to the provision of two arms 12 on each side may consist of notches at the four corners of the cover 11'. As a result, lateral extensions 23 are provided in the center plane of the second part 10' (which center plane contains also the slot 22), and said lateral extensions may serve, e.g., to interconnect similar second parts by film hinges or other means in a chain, which permits the plastic clips to be stored in a magazine and to be consecutively processed. It will be understood that corresponding measures may also be adopted in connection with the first clip part. For instance, said parts—but also the second parts—may be arranged in a row on pressure-sensitive adhesive tapes or joined by threads, which are pulled off or ruptured during the processing. It is also possible to store juxtaposed inconnected first and second parts of the clips in a magazine or the individual loose parts may be supplied to a processing apparatus, by which the parts are aligned to the correct position before the processing.

Alternatively, the injection-molded clip parts may be arranged in a row or may be interconnected by pressure-sensitive adhesive tapes or an applied adhesive film and arranged in a row as a magazine. Alternatively, the injection-molded clip parts may be stacked in a suitable form and can then be supplied to the closing machine.

I claim:

1. A plastic clip which serves to close sausage casings, bags or the like and consists of two parts, which embrace the wrapper end that has been gathered to form a tip and are adapted to be interlocked, and the tip is deflected in wave shape by at least one inwardly directed projection and is subjected to an applied pressure when the clip is in its interlocked closed state, characterized in that at least one part (1;1') of the plastic clip consists of an elongate frame, which extends transversely to the longitudinal direction of the tip and is optionally closed on the outside and has side bars (2), which are relatively high relative to their wall thickness and have centrally disposed aligned recesses (4), and that the projection is integrally formed at least with the second part (1; 10; 10'), which substantially covers the frame on the side on which the recesses (4) are disposed, and the projection consists of a rib (2*a*; 13), which is parallel to the side bars (2) and protrudes into the interior (5) of the frame, and is further characterized in that the recesses (4) in the side bars (2) are arcuate and the rib is an intermediate bar (2*a*), which is recessed to a smaller depth and extends parallel to the side bars.

2. A plastic clip according to claim 1, characterized in that both parts are framelike and are identically provided each with a projection (2*a*; 4*a*), which is eccentrically disposed between the side bars (2) and extends in the longitudinal direction and/or adapted to interlock with the recesses (4) facing each other.

3. A plastic clip according to claim 1, characterized in that a plurality of equal parts (1, 10, 1', 10') are connected to integrally formed lateral connecting bridges (e.g., so-called film hinges) to form chains, which are adapted to be stored in a magazine.

4. A plastic clip according to claim 1, characterized in that plurality of equal a parts (1, 10; 1'10') are connected by continuous tapes, threads or similar connecting means (which are optionally provided with pressure-sensitive adhesive finish) to form chains, which are adapted to be stored in a magazine.

5. A plastic clip which serves to close sausage casings, bags or the like and consists of two parts, which embrace the wrapper end that has been gathered to form a tip and are adapted to be interlocked, and the tip is deflected in wave shape by at least one inwardly directed projection and is subjected to an applied pressure when the clip is in its interlocked closed state, characterized in that at least one part (1;1') of the plastic clip consists of an elongate frame, which extends transversely to the longitudinal direction of the tip and is optionally closed on the outside and has side bars (2), which are relatively high relative to their wall thickness and have centrally disposed aligned recesses (4), and that the projection is integrally formed at least with the second part (1; 10; 10'), which substantially covers the frame on the side on which the recesses (4) are disposed, and the projection consists of a rib (2*a*; 13), which is parallel to the side bars (2) and protrudes into the interior (5) of the frame, and is further characterized in that a first part (1, 1') of the clip comprises an open frame, the side bars (2) of which comprise U-shaped recesses (4), a second part closes the U-shaped recesses of the first part (1,1'), and the rib (13) is integrally formed with the second part (10; 10').

6. A plastic clip according to claim 5, characterized in that both parts are framelike and are identically provided each with a projection (2*a*; 4*a*), which is eccentrically disposed between the side bars (2) and extends in the longitudinal direction and/or adapted to interlock with the recesses (4) facing each other.

7. A plastic clip according to claim 5, characterized in that the frame of the first part (1') is subdivided by an intermediate bar (20), which is parallel to the side bars (2), the intermediate bar (20) has a recess (21) which has a smaller depth than the recesses (4) in the side bars (2) and the second part (10') comprises two pairs of detent arms (12) which extend into respective interior spaces (5) of the frame.

8. A plastic clip according to claim 7, characterized in that a slot (22) is provided in the second part (10') and the intermediate bar (20) forces the tip of the wrapper into said slot (22).

9. A plastic clip according to claim 5, characterized in that a plurality of equal parts (1, 10, 1', 10') are connected to integrally formed lateral connecting bridges (e.g., so-called film hinges) to form chains, which are adapted to be stored in a magazine.

10. A plastic clip according to claim 5, characterized in that plurality of equal a parts (1, 10; 1' 10') are connected by continuous tapes, threads or similar connecting means (which are optionally provided with pressure-sensitive adhesive finish) to form chains, which are adapted to be stored in a magazine.

11. A plastic clip which serves to close sausage casings, bags or the like and consists of two parts, which embrace the wrapper end that has been gathered to form a tip and are adapted to be interlocked, and the tip is deflected in wave shape by at least one inwardly directed projection and is subjected to an applied pressure when the clip is in its interlocked closed state, characterized in that at least one part (1;1') of the plastic clip consists of an elongate frame, which extends transversely to the longitudinal direction of the tip and is optionally closed on the outside and has side bars (2), which are relatively high relative to their wall thickness and have centrally disposed aligned recesses (4), and that the projection is integrally formed at least with the second part (1; 10; 10'), which substantially covers the frame on the side on which the recesses (4) are disposed, and the projection consists of a rib (2*a*; 13), which is parallel to the side bars (2) and protrudes into the interior (5) of the frame, one part (1; 1') having cross-bars (3) which are formed with detent recesses (6) and detent arms (12,14) integrally formed with the other part (10, 10') extending behind said recesses (6) in a closed state.

12. A plastic clip according to claim 11, characterized in that both parts are framelike and identically provided each with a projection (2*a*; 4*a*), which is eccentrically disposed between the side bars (2) and extends in the longitudinal direction and/or adapted to interlock with the recesses (4) facing each other.

13. A plastic clip according to claim 11, characterized in that the rib (13) merges into at least one of the detent arms (12).

14. A plastic clip according to claim 29, characterized in that the two cross-bars (3) of each part are formed each with a detent recess (6*a*) and a detent arm (12), which are juxtaposed but offset cross-wise (FIG. 1).

15. A plastic clip according to claim 11, characterized in that the detent arms (12) of the second part (10; 10')—when viewed toward the U-shaped recess—are disposed on both sides beside the recesses (4) (offset in the direction of view) in a closed state.

16. A plastic clip according to claim 11, characterized in that the detent arms (12) are tapered.

17. A plastic clip according to claim 11, characterized in that a plurality of equal parts (1, 10, 1', 10') are connected to integrally formed lateral connecting bridges (e.g., so-called film hinges) to form chains, which are adapted to be stored in a magazine.

18. A plastic clip according to claim 11, characterized in that plurality of equal a parts (1, 10; 1' 10') are connected by continuous tapes, threads or similar connecting means (which are optionally provided with pressure-sensitive adhesive finish) to form chains, which are adapted to be stored in a magazine.

* * * * *

UNITED STATES PATENT AND TRADEMARK OFFICE

CERTIFICATE OF CORRECTION

PATENT NO. : 5,546,637
DATED : August 20, 1996
INVENTOR(S) : Niedecker, Herbert

It is certified that error appears in the above-indentified patent and that said Letters Patent is hereby corrected as shown below:

| | |
|---|---|
| Title Page | ABSTRACT: Line 9 delete " and " and substitute -- end -- |
| Col. 7, line 17 | Before " plurality " insert -- a --, after " equal " delete " a " |
| Col. 8, line 4 | After " that " insert -- a --, after " equal " delete " a " |
| Col. 8, claim 14 line 1 | After " claim " delete " 29 " and substitute -- 11 -- |
| Col. 8, line 59 | After " that " insert -- a --, after " equal " delete " a " |

Signed and Sealed this

Fifth Day of August, 1997

Bruce Lehman

*Attest:*

BRUCE LEHMAN

*Attesting Officer*

*Commissioner of Patents and Trademarks*

--